United States Patent [19]

Solomon

[11] 4,353,755

[45] Oct. 12, 1982

[54] METHOD OF MAKING HIGH STRENGTH DUPLEX STAINLESS STEELS

[75] Inventor: Harvey D. Solomon, Schenectady, N.Y.

[73] Assignee: General Electric Company, Schenectady, N.Y.

[21] Appl. No.: 201,840

[22] Filed: Oct. 29, 1980

[51] Int. Cl.[3] ..... C21D 1/26; C21D 6/02

[52] U.S. Cl. ..... 148/136; 148/38

[58] Field of Search ..... 148/37, 38, 136, 135; 75/125, 128 T, 128 F

[56] References Cited

U.S. PATENT DOCUMENTS

| | | | |
|---|---|---|---|
| 3,444,011 | 5/1969 | Nagashima et al. | 148/31 |
| 3,551,142 | 12/1970 | Decroix | 75/125 |
| 4,055,448 | 10/1977 | Fujikura et al. | 148/38 |

FOREIGN PATENT DOCUMENTS

| | | | |
|---|---|---|---|
| 54-46117 | 4/1979 | Japan | 75/128 T |
| 54-121224 | 9/1979 | Japan | 148/38 |

OTHER PUBLICATIONS

Southwick et al., "The Early Stages of the Decomposition of Ferrite to Austenite in a Stainless Steel," Phase Transformations, vol. 2, published by the Institution of Metallurgists, London, England, 1979, pp. II-74 to II-76.

Peckner et al., *Handbook of Stainless Steels,* "Structure and Composition of Wrought Microduplex Stainless Steels," McGraw-Hill Book Co., 1977, pp. 8-1 to 8-22.

*Primary Examiner*—Peter K. Skiff

*Attorney, Agent, or Firm*—Stephen S. Strunck; James C. Davis, Jr.; Joseph T. Cohen

[57] ABSTRACT

The yield strength and tensile strength of a duplex stainless steel alloy body are substantially increased and its anisotropy is substantially reduced by heating it until it is completely ferritic or nearly so and then aging it to cause fine austenitic precipitates to form throughout the body.

11 Claims, 4 Drawing Figures

METHOD OF MAKING HIGH STRENGTH DUPLEX STAINLESS STEELS

The present invention relates generally to duplex stainless steel alloys consisting of austenite and ferrite mixtures and is more particularly concerned with iron-chromium duplex stainless steels having superior yield strength, tensile strength and diminished anisotropy and is also concerned with a novel heat treating method for producing those unique products.

BACKGROUND OF THE INVENTION

Duplex stainless steels exemplified by the commercial Uranus 50 alloy of Creusot Loire Steel Co. of France contain both austenite (gamma phase) and ferrite (alpha phase) and sufficient chromium for corrosion resistance. The composition of the heat used is listed in Table I. These alloys exhibit marked resistance to both transgranular and intergranular stress corrosion cracking. They possess an anisotropic microstructure attributable to the normal processing of these alloys which involves unidirectional hot working them in the two-phase condition and then heat treating them in the alpha plus gamma temperature range. Furthermore, in addition to anisotropy, this processing gives the alloys only moderate strength. The anisotropic structure produced by conventional processing is shown in FIG. 1. The tensile properties developed by this conventional processing are listed in Table II (See the results for specimens No. 23 and 54.). The impact properties are listed in Table III (See specimens No. 301 and 326.).

SUMMARY OF THE INVENTION

By virtue of the present invention based upon my new concepts and discoveries set forth below, it is possible by heat treatment alone to strengthen substantially duplex stainless steel alloy bodies and at the same time reduce the anisotropy of their impact properties. Further, these results can be obtained consistently and with a wide variety of different duplex stainless steel alloy compositions and without an unacceptable penalty in terms of other physical properties including impact strength and ductility.

It is my novel concept that physical properties of duplex stainless steel alloys in general can be improved by tailoring their microstructures in a particular manner. It is further my idea that by heat treating such an alloy body to convert it to single phase ferritic form and then aging it to regenerate the duplex structure by producing the austenitic phase in favorable proportion and distributional pattern, a product can be obtained having superior yield strength and tensile strength and substantially diminished microstructural and physical property anisotropy.

Briefly described, the novel method of this invention includes the steps of heating a duplex stainless steel alloy body and thereby converting the metal of the body to the ferritic microstructure, then reducing the temperature of the body while retaining the resulting microstructure substantially unchanged, thereafter heat aging the body and thereby precipitating austenitic phase and thereby producing a duplex alpha-gamma microstructure. In the preferred practice of this process, the work piece is quenched to about room temperature immediately following the first heating step and also immediately following the second heating step.

Similarly briefly described, the new products of this invention have superior yield strength and tensile strength characteristics and their alloy structures consist of ferrite and austenitic grains and are substantially free from sigma phase.

DETAILED DESCRIPTION OF THE INVENTION

In processing a duplex stainless steel body in accordance with this invention, regardless of its thermal or its hot or cold-working history, it is heated in a neutral atmosphere (i.e., an atmosphere in which the metal body is non-reactive under prevailing temperature conditions) to a temperature in a range sufficiently high to result in conversion of the duplex structure into ferritic phase with little or no retained austenite being present. This range for most iron-chromium duplex alloys of this type will be from 1300° to 1375° C. A completely ferritic structure is established at the upper end of this temperature range, while at the lower end of this range some austenite is retained. This retained austenite limits the ferrite grain growth, which is desirable, but is unfortunately also lessens the amount of hardening by reducing the amount of ferrite which can subsequently be hardened by gamma phase precipitation. Following the duplex structure-elimination heating step, the work piece is cooled rapidly to about room temperature, preferably by a water quench.

The heat aging step is then carried out, the work piece being rapidly brought from about room temperature up to 700° C. It is maintained at that temperature in the alpha plus gamma range as fine gamma phase precipitates which form through the body. At 700° C., the optimum microstructural results are obtained in about one-half hour at temperature whereupon the work piece is water quenched or otherwise rapidly cooled to about room temperature. This heat aging step may, as indicated above, be carried out at higher temperatures than 700° C. and may in fact be as high as 1100° C. and even anywhere in the range between about 600° and 1100° C. The higher the temperature in that range, the coarser in general will be the gamma phase. My preference, as also indicated above, however, is to carry out this heat aging step at 700° C. or thereabout for approximately one-half hour, thereby producing the optimum combination of physical properties as will be described in more detail.

Figure 2:
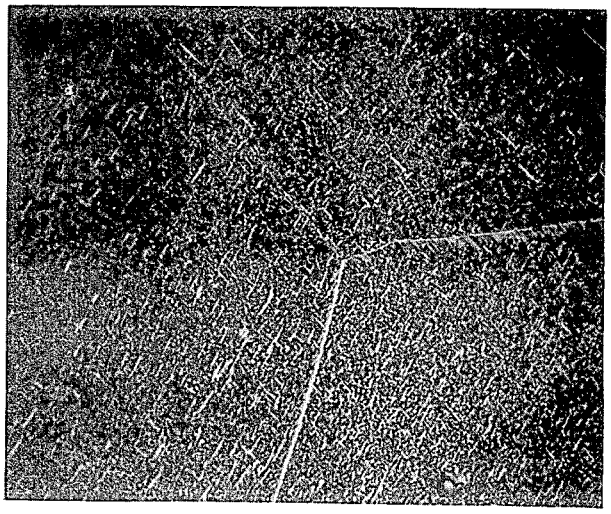
FIG. 2 is a photomicrograph (200×) of the alloy of FIG. 1 after processing in accordance with this invention by heat treating at 1375° C. and water quenching, followed by annealing at 700° C. for 0.5 hour.

FIG. 2 illustrates the structure established by a 1375° C. anneal followed by a 700° C. for 0.5 hour aging treatment. The 1375° C. annealing temperature is above the gamma solvus so no gamma is present to restrain the alpha grain growth. The 700° C. aging treatment causes fine gamma precipitates to form in the coarse-grained alpha. This gamma precipitation strengthens the alloy and is the basis of this invention. It also prevents the twinning which is the primary deformation mode in specimens heat treated to give an all ferritic structure but not further heat treated to cause the gamma precipitation. The all ferritic structure is brittle due to the twinning and is therefore undesirable.

The following illustrative examples of this invention as actually carried out in practice will serve to define the salient features and advantages thereof to the full understanding of those skilled in the art.

EXAMPLE I

An iron-chromium duplex alloy heat was prepared of the following composition set out in Table I below.

TABLE I

| Uranus 50 Alloy Analysis | |
|---|---|
| Element | Percentage |
| Cr | 21.08 |
| Ni | 7.38 |
| Mo | 2.30 |
| Cu | 1.33 |
| Mn | 0.62 |
| Si | 0.45 |
| C | 0.032 |
| S | 0.021 |
| P | 0.022 |
| N | 0.071 |
| B | 0.003 |
| Ti | 0.01 |
| Fe | BALANCE |

The heat was cast to produce an ingot and sections of the ingot wet hot worked to large diameter bar from which slabs were cut, forged and unidirectionally hot rolled to produce a plate 0.5 inch thick. This hot rolling operation was carried out at 1050° to 1100° C. and the resulting plate was water quenched at room temperature. Charpy and tensile specimens were prepared from this plate. These specimens were subsequently heat treated at 1375° C. for two hours following which they were water quenched to about room temperature and then heated again to 700° C. for thirty minutes, 2 hours or 24 hours and finally water quenched to about room temperature. The result of room temperature tensile tests on these specimens is shown in Table II. The tensile specimens in question are numbers 406, 407, 462 and 464 of Table II.

Table II (for specimens 406 and 407) shows that the 1375° C. anneal and a half hour aging treatment at 700° C. has yielded a material with a 0.2% offset strength of 96.5 ksi and 100.5 ksi, an ultimate tensile strength of 119.0 ksi and 107.5 ksi, a strain to ultimate tensile strength of 12% and 10% and a percent reduction in area of 45% and 42%. Aging for 24 hours causes clear metallographic indications of sigma phase. Some indications of sigma phase are also present after two hours at 700° C. This difference in the amount of sigma phase is reflected in the reduction in area measurements. Twenty four hours at 700° C. reduced the percent reduction in area to 15% (specimen 464) whereas two hours at 700° C. reduced it to only 31% (specimen 462). The precipitation of sigma phase sets the upper limit of aging time at 700° C. at two hours if it was desired to completely eliminate sigma phase. Specimens 462 and 464 are T type specimens with the tensile axis transverse to the rolling direction. Discounting the effects of sigma phase, which are small after only a two hour age at 700° C., one can see that there is little anisotropy between L and T type specimens (i.e., between the results of tests of specimens numbered 406, 407 and 462).

Figure 1:
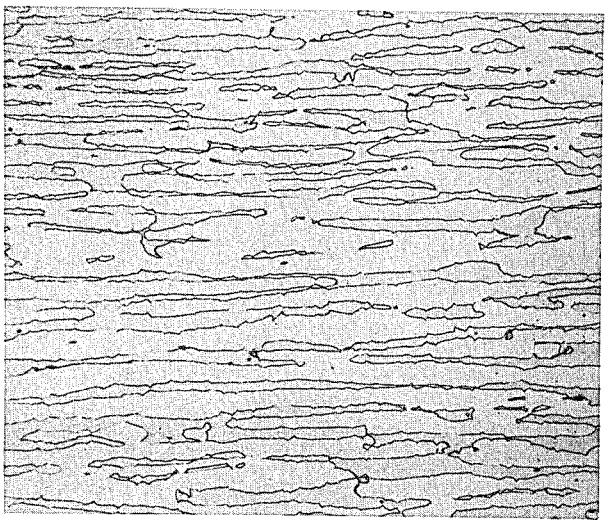
FIG. 1 is a photomicrograph (200×) of a standard duplex stainless steel alloy hot worked at 1150° C. and water quenched in accordance with heretofore conventional practice.

Table III (for specimens 304, 305, 336 and 337), shows that the room temperature impact energy for specimens annealed at 1375° C. and then aged 0.5 hours at 700° C. is about 56 foot pounds (the average for the results from specimens No. 304, 305, 336 and 337). The results of specimens 304, 205, 336 and 337 show that the heat treatment cycles covered by this invention do not give rise to anisotropy in the room temperature charpy impact energy. The impact energy of specimens (numbers 304 and 305) in which the crack growth plane is normal to the long transverse direction and the crack growth direction is in the longitudinal rolling direction (TL type specimens) possess roughly the same room temperature impact energy as specimens (numbers 336 and 337) in which the crack growth plane is in the longitudinal rolling direction and the crack growth direction is in the short transverse direction (LS type specimens). In contrast, conventional processing gives rise to considerable anisotropy. This is illustrated with the data for specimens 301 and 326 of Table III. Processing at 1100° C. gives rise to the structure shown in FIG. 1, in which the TL impact energy is only 90.0 foot pounds compared to 218.5 foot pounds for an LS specimen. While these impact energies are higher than that developed by this invention, the TL type specimens possess an impact energy which is only about one third higher. The tensile strength of the conventionally processed material is not as large as that produced by this invention. For instance, annealing at 1375° C. and aging at 700° C. raises the 0.2% tensile strength from about 55 ksi to about 95 ksi, an increase of over 70%. The tensile behavior of the conventionally processed material is listed in Table II (specimens 23 and 54). The results of specimens 404, 449, 450, 473, 474, and 475 show that aging the conventional structure does not cause the increase in strength developed by this invention, only the small alterations in the tensile behavior due to sigma phase are noted after 24 hours at 700° C.

The development of sigma phase at 700° C. is most clearly illustrated by the impact tests. Aging 24 hours at 700° C. (see specimen No. 377) results in severe sigma phase embrittlement. The deleterious influence of sigma phase is also manifest after two hours (see specimens No. 376 and 1011). These results set an upper limit of 2 hours on the aging time at 700° C.

EXAMPLE II

In another experiment carried out as described in reference to Example I, other specimens were annealed at 1350° C. for two hours, then water-quenched to room temperature heat aged at 700° C. for thirty minutes, two hours or 24 hours and then water quenched to room temperature. The tensile specimens in question are numbers 400 and 401. The room temperature charpy test results are shown in Table III. The specimens in question are numbers 330, 331, 332 and 378.

Table II (for specimens 400 and 401) shows that the 1350° C. anneal and 700° C. aging treatment has yielded a material with a 0.2% offset yield strength of about 100 ksi (105 ksi and 97.0 ksi for specimens 400 and 401) an ultimate tensile strength of about 130 ksi (126.5 ksi and 133.0 ksi for specimens 400 and 401, a strain to ultimate tensile strength of about 9.5% (10% and 9% for specimens 400 and 401) and a reduction in area of about 37% (48% and 26% for specimens 400 and 401). These results were obtained for specimens oriented with the tensile axis in the rolling direction (L type specimens).

Table III (for specimens 330, 331, 332 and 378) shows that the room temperature charpy energy for specimens annealed at 1350° C. and then aged at 700° C. for 0.5 hours is about 80 foot pounds (87.5 foot pounds and 71.5 foot pounds for specimens 330 and 332). Aging for 24 hours at 700° C. causes sigma phase to form in the alpha phase and this causes the observed reduction in the impact strength of specimen 331 to only 60 foot pounds. Sigma phase has reduced the reduction in area in tensile specimen 401 and has raised the ultimate tensile strength. The start of sigma phase precipitation is observed after 2 hours. This precipitation reduces the impact energy (see table II specimen No. 378) but not as much as that due to a 24 hour age, where more sigma phase is created.

TABLE II

Room Temperature Tensile Results (Cross Head Rate for All Tests 0.1 in/min)

| Specimen No. | Orientation | Annealing Temperatures | Aging Conditions | Yield Strength (.2%) ksi | Ultimate Tensile Strength ksi | Strain to Ultimate Tensile Strength % | Reduction In Area At Fracture % |
|---|---|---|---|---|---|---|---|
| 23 | L | 1150° C. | None | 56.0 | 91.5 | 26 | 80 |
| 54 | T | 1150° C. | None | 55.0 | 95.5 | 27 | 74 |
| 406 | L | 1375° C. | 700° C.-0.5 hr | 96.5 | 119.0 | 12 | 45 |
| 407 | L | 1375° C. | 700° C.-0.5 hr | 100.5 | 107.5 | 10 | 42 |
| 462 | T | 1375° C. | 700° C.-2 hr | 90.4 | 112.6 | 6.5 | 31 |
| 464 | T | 1375° C. | 700° C.-24 hr | 96.1 | 157.0 | 5.9 | 15 |
| 449 | L | 1100° C. | 700° C.-0.5 hr | 53.6 | 91.7 | 29.2 | 74.2 |
| 450 | L | 1100° C. | 700° C.-2 hr | 50.7 | 93.7 | 31.0 | 73.2 |
| 404 | L | 1100° C. | 700° C.-24 hr | 60.0 | 102.5 | 9 | 21 |
| 473 | T | 1100° C. | 700° C.-0.5 hr | 50.7 | 97.8 | 29.1 | 67.3 |
| 475 | T | 1100° C. | 700° C.-2 hr | 56.3 | 99.5 | 28 | 64.0 |
| 474 | T | 1100° C. | 700° C.-24 hr | 58.3 | 112.3 | 11.9 | 16.0 |
| 400 | L | 1350° C. | 700° C.-0.5 hr | 105.0 | 126.5 | 10 | 48 |
| 401 | L | 1350° C. | 700° C.-24 hr | 97.0 | 133.0 | 9 | 26 |

EXAMPLE III

Figure 3:
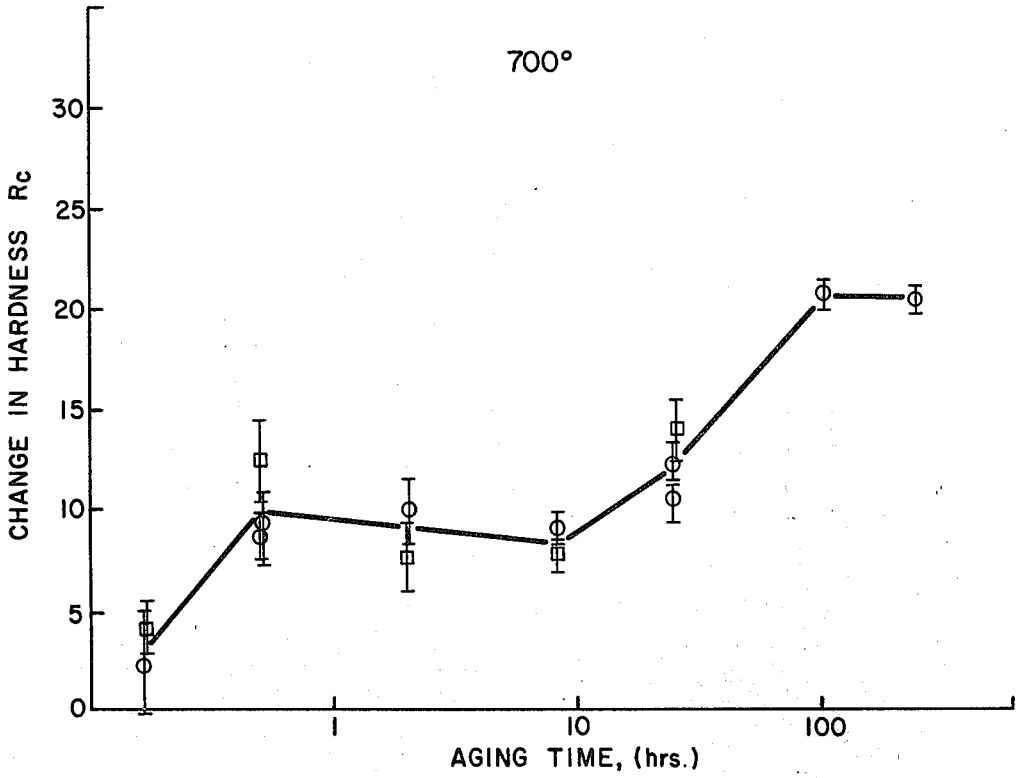
FIG. 3 is a chart on which Rockwell-C hardness is plotted against time in hours at 700° C.

Two series of heat aging experiments were carried out at 600° C. and 700° C. for periods of 10 minutes to over 100 hours to determine the effect on hardness of products of the process of this invention of those varied conditions. In each instance, the work piece was a plate produced from the Example I ingot and heat treated at 1375° C. for one or two hours. The results of these tests are illustrated by the FIG. 3 and FIG. 4 charts which show how the Rockwell C hardness increased with aging time at 700° C. or 600° C. The figures show the hardness increase relative to the initial hardness which varied slightly from specimen group to specimen group. The error bars refer to one standard deviation.

The initial increase in hardness at 700° C. is due to the gamma precipitation and the secondary hardening due to the alpha to sigma conversion. The 700° C. aging data shows that gamma precipitation is detectable in as little as ten minutes, which is confirmed by metallography. This sets a lower time limit for aging at 700° C. The start of sigma phase precipitation after two hours at 700° C. sets the upper time limit. Aging more than two hours results in increased hardness due to sigma phase precipitation.

Figure 4:
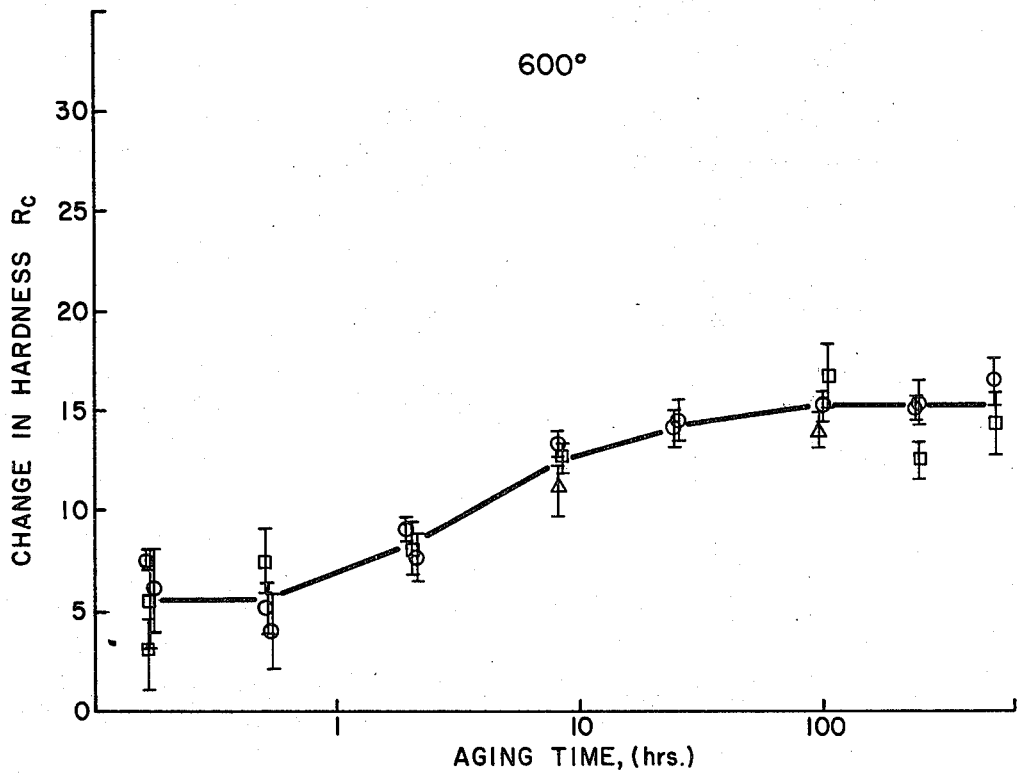
FIG. 4 is a chart like that of FIG. 3 except that the aging temperature was 600° C.

The aging behavior at 600° C. is shown in FIG. 4. Transmission electron microscopy shows that the initial hardening at ten minutes and thirty minutes is due to a precipitation in the alpha phase of alpha prime, a chromium-rich body-centered cubic (bcc) phase similar to alpha. The increase in hardness at two hours is due to the gamma precipitation. Concurrently, the alpha prime becomes unstable and an alpha plus gamma structure of the sort shown in FIG. 2 is created. With times in excess of ten hours, the development of sigma phase is the same as at 700° C. The upper time limit for aging at 600° C. is thus set at ten hours if it is desired to avoid sigma phase. The increase in hardness after two hours at 600° C. sets this as a lower limit on the aging time.

TABLE III

Room Temperature Charpy Impact Energy

| Specimen No. | Orientation | Annealing Temperature | Aging Conditions | Impact Energy |
|---|---|---|---|---|
| 301 | TL | 1100° C. | None | 90.0 |
| 326 | LS | 1100° C. | None | 218.5 |
| 304 | TL | 1375° C. | 700° C.-0.5 hr | 55.5 |
| 305 | TL | 1375° C. | 700° C.-0.5 hr | 61.5 |
| 336 | LS | 1375° C. | 700° C.-0.5 hr | 50.0 |
| 337 | LS | 1375° C. | 700° C.-0.5 hr | 57.0 |
| 376 | LS | 1375° C. | 700° C.-2 hr | 15.0 |
| 377 | LS | 1375° C. | 700° C.-24 hr | 5.0 |
| 1011 | TL | 1375° C. | 700° C.-2 hr | 26.0 |
| 330 | LS | 1350° C. | 700° C.-0.5 hr | 87.5 |
| 332 | LS | 1350° C. | 700° C.-0.5 hr | 71.5 |
| 378 | LS | 1350° C. | 700° C.-2 hr | 14.0 |
| 331 | LS | 1350° C. | 700° C.-24 hr | 6.0 |

What I claim as new and desire to secure by Letters Patent of the United States is:

1. A method for heat treating a duplex stainless steel alloy body which comprises the steps of:

(1) heating said alloy body to a first temperature and maintaining said first temperature for a first time sufficient to convert said duplex microstructure to a substantially ferritic microstructure;

(2) cooling said alloy body to about room temperature at a rate sufficient to retain said substantially ferritic microstructure;

(3) heating said alloy body to a second temperature and maintaining said second temperature for a time sufficient to precipitate austenite, but insufficient to precipitate sigma phase, in said substantially ferritic microstructure; and (4) cooling said alloy body to about room temperature at a rate sufficient to retain the microstructure developed in step (3) thereby producing a duplex stainless steel alloy body having a microstructure of austenite precipitates in a ferritic matrix, substantially isotropic yield and tensile strengths, substantially isotropic impact properties of at least about 50 ft-lbs and a minimum yield strength of at least 90 ksi.

2. The method of claim 1 wherein said first temperature is between about 1300° C. and about 1375° C.

3. The method of claim 1 wherein said second temperature is between about 600° C. and about 1100° C.

4. The method of claim 3 wherein said second temperature is about 700° C.

5. The method of claim 1 wherein said second time is from about 10 minutes to about 120 minutes.

6. The method of claim 5 wherein said second time is about 30 minutes.

7. The method of claim 1 wherein said stainless steel alloy body contains about 21.0% chromium, about 7.4% nickel, about 2.3% molybdenum, about 1.3% copper, about 0.6% manganese, about 0.5% silicon, about 0.020% sulfur, about 0.03% carbon, about 0.02% phosphorus, about 0.07% nitrogen, about 0.003% boron, less than about 0.01% titanium, the balance being iron.

8. The method of claim 7 wherein said first temperature is about 1375° C., said first time is about 2 hours, said cooling steps are accomplished by water quenching said body, said second temperature is about 700° C. and said second time is about 30 minutes.

9. The method of claim 7 wherein said first temperature is about 1350° C., said first time is about 2 hours, said cooling steps are accomplished by water quenching said body, said second temperature is about 700° C. and said second time is about 30 minutes.

10. The method of claim 7 wherein said first temperature is about 1375° C., said first time is between about 1 hour and about 2 hours, said cooling steps are accomplished by water quenching said body, said second temperature is about 600° C. and said second time is in the range of from about 2 hours to about 10 hours.

11. The product made in accordance with the method of claim 7.

* * * * *